US005323907A

United States Patent [19]

Kalvelage

[11] Patent Number: 5,323,907

[45] Date of Patent: Jun. 28, 1994

[54] CHILD RESISTANT PACKAGE ASSEMBLY FOR DISPENSING PHARMACEUTICAL MEDICATIONS

[75] Inventor: John D. Kalvelage, Lynchburg, Va.

[73] Assignee: Multi-Comp, Inc., Lynchburg, Va.

[21] Appl. No.: 31,657

[22] Filed: Mar. 15, 1993

Related U.S. Application Data

[63] Continuation of Ser. No. 902,985, Jun. 23, 1992, abandoned.

[51] Int. Cl.[5] ..... A61J 1/00

[52] U.S. Cl. ..... 206/531; 206/534; 206/539

[58] Field of Search ..... 206/528-540, 206/461-471

[56] References Cited

U.S. PATENT DOCUMENTS

| | | | |
|---|---|---|---|
| Re. 29,705 | 7/1978 | Compere . | |
| D. 322,934 | 1/1992 | Kalvelage . | |
| D. 323,109 | 1/1992 | Kalvelage . | |
| 2,809,863 | 10/1957 | Curran . | |
| 3,173,540 | 3/1965 | Lapides . | |
| 3,397,671 | 8/1968 | Hartman, Jr. et al. . | |
| 3,494,322 | 2/1970 | Dubbels . | |
| 3,503,493 | 3/1970 | Nagy . | |
| 3,603,453 | 9/1971 | Serrell et al. . | |
| 3,780,856 | 12/1973 | Braverman . | |
| 3,856,144 | 12/1974 | Kelly . | |
| 3,921,805 | 11/1975 | Compere . | |
| 3,924,746 | 12/1975 | Haines . | |
| 3,924,747 | 12/1975 | Gerner . | |
| 3,948,394 | 4/1976 | Hellstrom . | |
| 4,106,621 | 8/1978 | Sorensen . | |
| 4,125,190 | 11/1978 | Davie, Jr. et al. . | |
| 4,211,326 | 7/1980 | Hein et al. . | |
| 4,231,477 | 11/1980 | De Felice . | |
| 4,254,871 | 3/1981 | Poore . | |
| 4,340,141 | 7/1982 | Fischer . | |
| 4,416,375 | 11/1983 | Braverman et al. . | |
| 4,429,792 | 2/1984 | Machbitz . | |
| 4,444,310 | 4/1984 | Odell . | |
| 4,506,789 | 3/1985 | Dlugosz . | |
| 4,537,312 | 8/1985 | Intini . | |
| 4,958,736 | 9/1990 | Urheim | 206/531 |
| 4,988,004 | 1/1991 | Intini . | |
| 5,014,851 | 5/1991 | Wick . | |
| 5,019,125 | 5/1991 | Rebne et al. | 206/532 |
| 5,046,618 | 9/1991 | Wood . | |
| 5,050,739 | 9/1991 | Hannan et al. | 206/534 |

*Primary Examiner*—Jimmy G. Foster

*Attorney, Agent, or Firm*—Bell, Seltzer, Park & Gibson

[57] ABSTRACT

The present invention includes a package assembly which comprises a blister package and a surrounding frame having a child resistant feature. The blister package includes a blister sheet having blisters that form recesses adapted for receiving medications and a lidding sheet overlying the face of the blister sheet for enclosing medications in the blister recesses. The surrounding frame is designed for receiving and supporting the blister package and is made up of first and second panels. The apertures in each panel are correspondingly arranged so as to overlap in an opposing face-to-face relation. The apertures in the second panel are configured to partially obstruct the corresponding aperture in the first panel. The partial obstruction thereby forming a protective device to impede unwanted removal of medication from the blister package in a child resistant fashion.

17 Claims, 5 Drawing Sheets

CHILD RESISTANT PACKAGE ASSEMBLY FOR DISPENSING PHARMACEUTICAL MEDICATIONS

This application is a continuation of application Ser. No. 07/902,985, filed Jun. 23, 1992, now abandoned.

FIELD OF THE INVENTION

The pharmaceutical packaging industry is constantly changing and improving to try to meet the needs and safety requirements of the consuming public. Prescription medications by their very nature may be dangerous if they are accessible to children. In striving for child resistant packaging, however, there is the additional problem that such a package is also difficult for adults to open up or dispense medications from. This problem is true of patients advanced in age or those otherwise having limited dexterity or aptitude with respect to opening packages. The present invention relates to a pharmaceutical package that is designed to be child resistant yet accessible and user-friendly to adults. In addition to increasing child resistance, the present invention provides for customized prescription packaging to be economically handled by a patient's pharmacist.

BACKGROUND OF THE INVENTION

The pharmaceutical packaging industry offers a wide array of dispensers and containers for all types of medications. These packages include many types of child resistant features such as different styles of safety caps in conjunction with a conventional prescription bottle. With respect to blister card style packaging, child resistant features include a reinforced additional backing sheet. In all these cases of existing child resistant packaging there exists a substantial danger that patients—the intended users of the medications—cannot get into a package to gain access to the medication. Patients will get frustrated in their efforts to get to the medication and may simply ignore the instructions to take them. This potentially harmful situation involves patients having advanced age, or any patient have dexterity problems such as a result of arthritis, or anyone else who simply lacks an aptitude for opening child resistant packages. Specifically, with respect to blister cards having a reinforced backing layer, it is necessary to go through the extra mechanical step of peeling off the reinforcing backing before a patient can punch the medication through the frangible backing layer. Further, many patients may not be aware of the reinforcing backing on existing child resistant blister cards and may inadvertently tear or damage an entire package in seeking to obtain the medications from it and possibly spoil the medications as a result thereof.

SUMMARY OF THE INVENTION

The present invention overcomes the drawbacks of these prior art packages by providing a package assembly which comprises a blister package and a surrounding frame having a child resistant feature. The blister package includes a blister sheet having a plurality of blisters that form recesses adapted for receiving medications and a lidding sheet overlying the face of the blister sheet for enclosing medications in the blister recesses. The surrounding frame is designed for receiving and supporting the blister package and is made up of first and second panels and a hinge joining those panels along adjacent edges thereof, the panels being folded into opposing face-to-face relation for sandwiching the blister package therebetween. Both the first and second panels have apertures having a predetermined configuration. The apertures are correspondingly arranged so that the apertures in the first panel overlie the apertures in the second panel when the panels are folded together into the opposing face-to-face relation. The apertures in the second panel are further configured as to partially obstruct the corresponding aperture in the first panel, the partial obstruction thereby forming a protective device to impede unwanted removal of medication from the blister package in a child resistant fashion. In a preferred embodiment, the frame that supports the blister package comprises two different panels that are configured to be used to package capsules or tablets in the blisters that are received in the recesses of the first panel or the second panel respectively.

The blister sheet may have indentations or bumps in a predetermined location in each blister to assist a patient in identifying that portion of the blister to press to successfully extract medication from the package. Alternatively, the blisters may have a non-uniform thickness that enhances the child resistant properties of the package while also allowing easier access to the medications. The plastic is thick and therefore relatively hard on the end which is required to be pressed to free the medication. The opposite side of blister is thin and allows a patient to squeeze or pinch the medication out of the package more easily.

In a further embodiment, the plastic frame incorporates an identifying alphanumeric grid to assist a patient in comparing the front and back of the package by identifying which blister to press to gain access to the medications therein.

Other features and advantages of the present invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention.

In the drawings.

DETAILED DESCRIPTION OF THE PREFERRED EMBODIMENT

Figure 1:
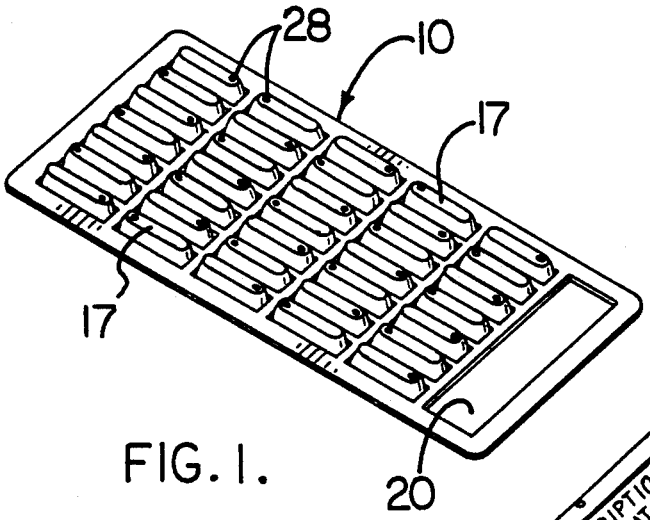
FIG. 1 is a perspective view of a blister package assembly embodying the present invention.
Figure 2:
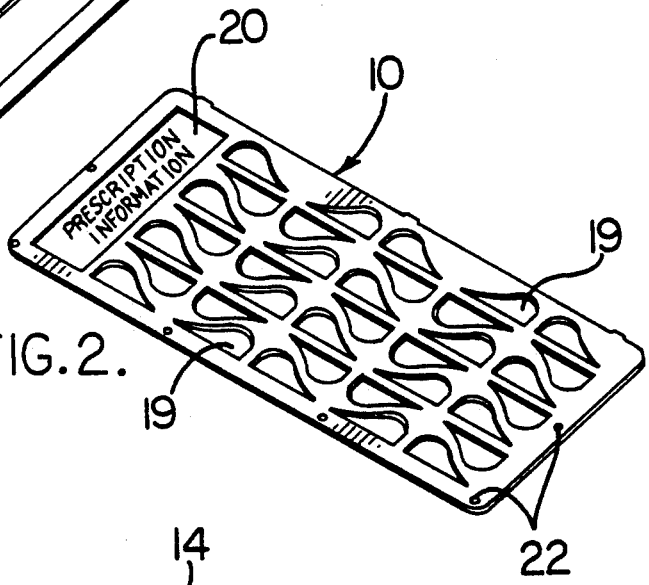
FIG. 2 is a perspective view of the blister package assembly viewed from the bottom.

Turning first to FIGS. 1 and 2, there is shown a preferred embodiment of a complete package assembly 10 which embodies the present invention. As seen in FIG. 1, a plurality of blisters 17 protrude from the front side of the package assembly, each blister containing medication in the form of a capsule. The opposite side of the package assembly, shown in FIG. 2, has a plurality of openings 19 through which the medication is dispensed as explained more fully below.

The package assembly is made up of a blister package 11 and a surrounding mounting frame 14. The blister package 11, in turn, includes a blister sheet 12 and an overlying lidding sheet or backing sheet 13 on the rear surface of the blister sheet. The blister sheet has a plurality of blister recesses 17 formed therein.

The blister sheet 12 is formed from a flat, clear plastic sheet of a suitable transparent thermoplastic polymer such as polyvinyl chloride or polyethylene terepthalate which has been thermoformed or die molded to form the pattern of blister recesses. The blister recesses 17 are arranged in a plurality of columns and rows and are separated by substantially planar shoulder portions 27. The peripheral portions of the sheet adjacent the edges of the sheet are also substantially flat and planar. Although not illustrated, score lines may be provided in the shoulder portions of the blister sheet to form preweakened areas to facilitate separating the individual blisters from the package. This allows a patient's unused medications or blister recesses to be separated easily from the package and recycled or reused in other package assemblies.

The frame 14 is preferably formed of a single molded plastic sheet and includes first and second panels 15 and 16 which are hingedly connected to each other by hinge 21 formed with a flexible integral piece of plastic along adjacent side edges of the panels. On the side edge of the panels opposite the edge hingedly interconnecting the panels and along both ends, there are snaps 22 or other releasable interengaging means that hold the panels together and sandwiched around the package. The two panels 15 and 16 are generally rectangular in shape. Each panel has rows and columns of apertures 18 and 19. In the preferred embodiment the apertures are laid out in a 5×7 grid that approximates the grid of a calendar. At the corresponding ends of each panel are larger apertures 30 and 31. Thus, the stiff frame is positioned on opposite sides of the blister package and offers support to the entire package. Although a plastic molded sheet is preferred for use as the frame, primarily because of its stiffness and its reusability, it will be understood that other materials may be used as the frame material, such as cardboard or paper products.

The blister recesses 17 of the blister sheet 12 are arranged in a grid or pattern that correspond to the apertures or openings 18 of the first panel 15. When the package is mounted in the frame, each blister recess is fully supported by the stiff outer frame 14 because the frame encases the package and is positioned on both sides of the package in a sandwich relationship. The second panel 16 of the frame also has apertures 19 that serve as windows to allow portions of the backing sheet 13 of the blister package to be visible. Printed information regarding the medications in each blister is printed on the lidding sheet 13. This printed information preferably gives all of the information or labeling requirements of the pharmaceutical medications that are sealed in each of the blisters of the package. As seen in FIGS. 1–7, one end or side of the frame also includes a large window 20 defined by the larger apertures 30 and 31 of each panel where medical or prescription information can be displayed.

Figure 3:
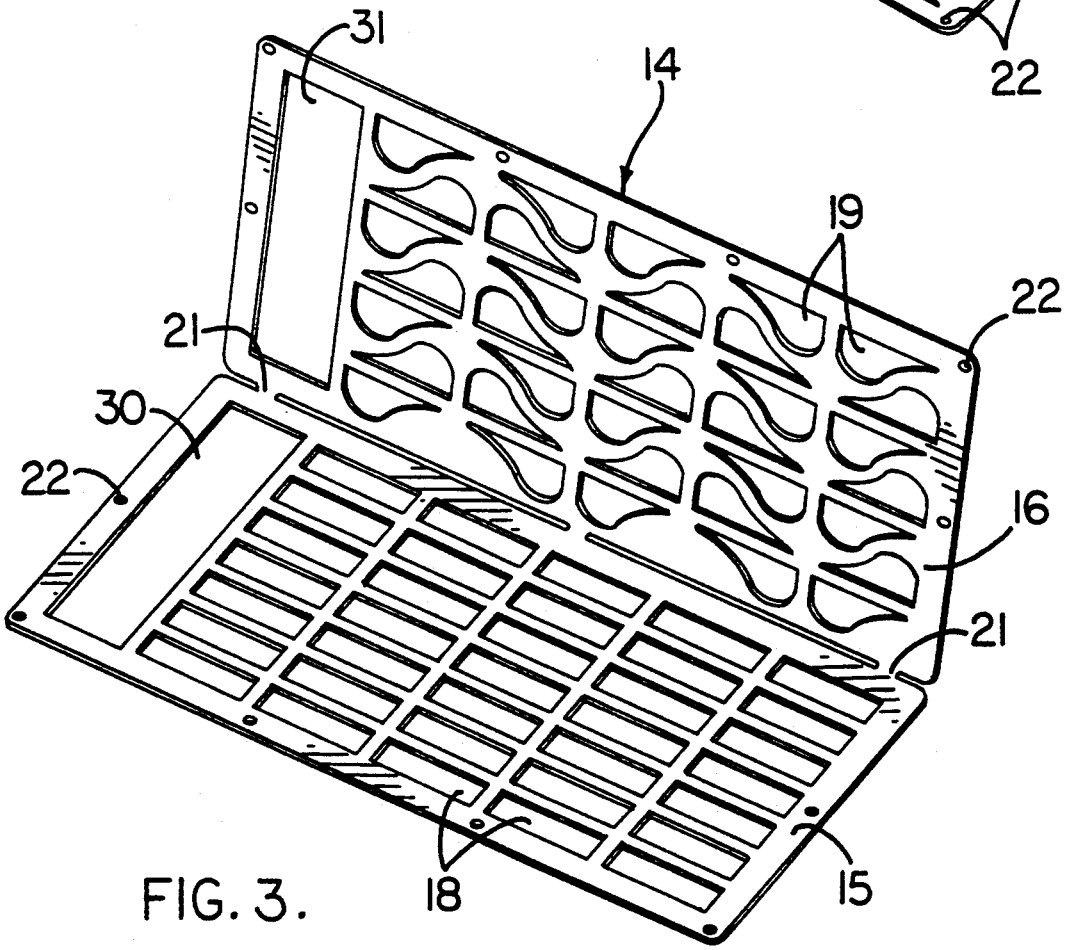
FIG. 3 is a perspective view of the plastic frame in the open position.
Figure 4:
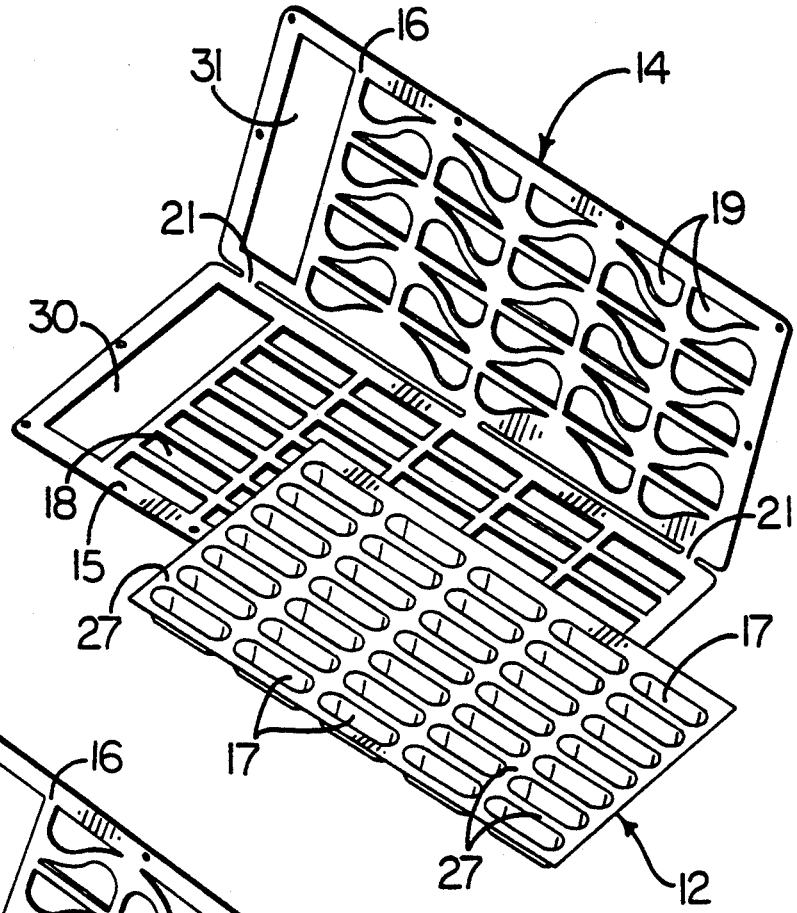
FIG. 4 is a perspective view of a partially assembled package assembly showing the frame in the open position and the blister sheet.
Figure 5:
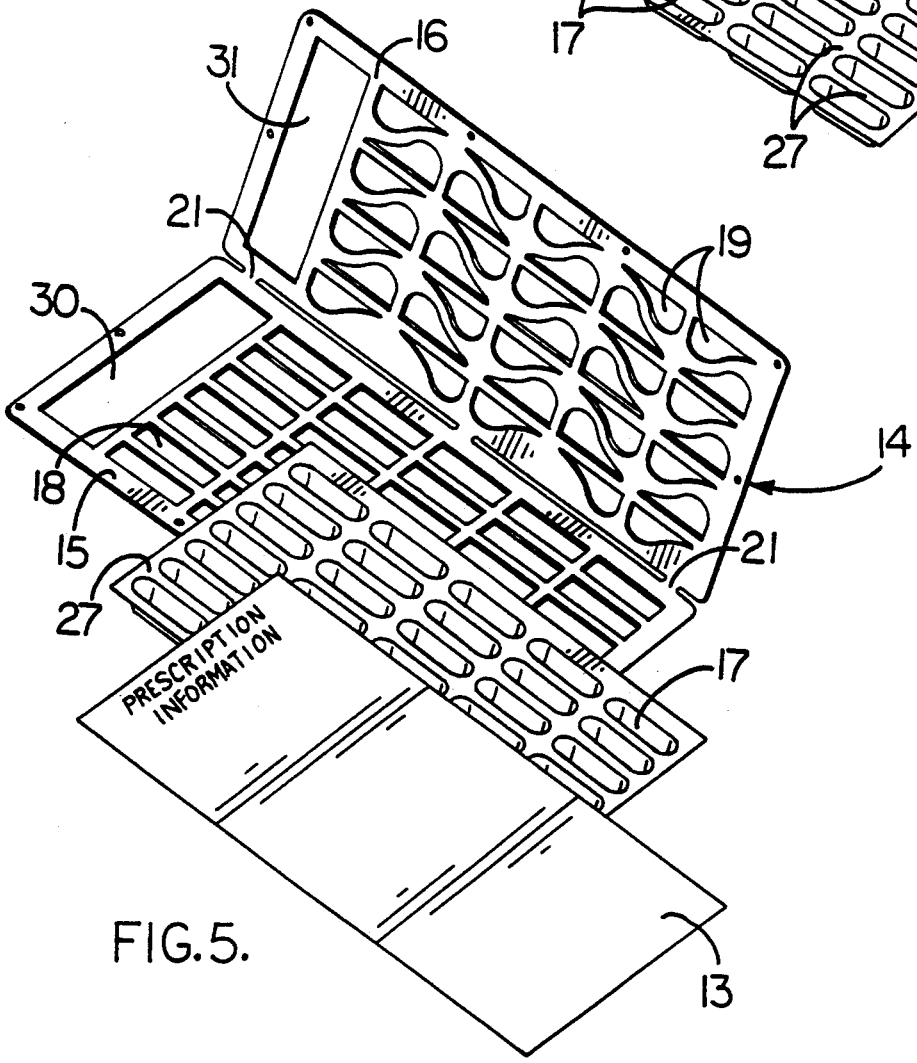
FIG. 5 is a perspective view similar to FIG. 4 also showing the lidding sheet.
Figure 6:
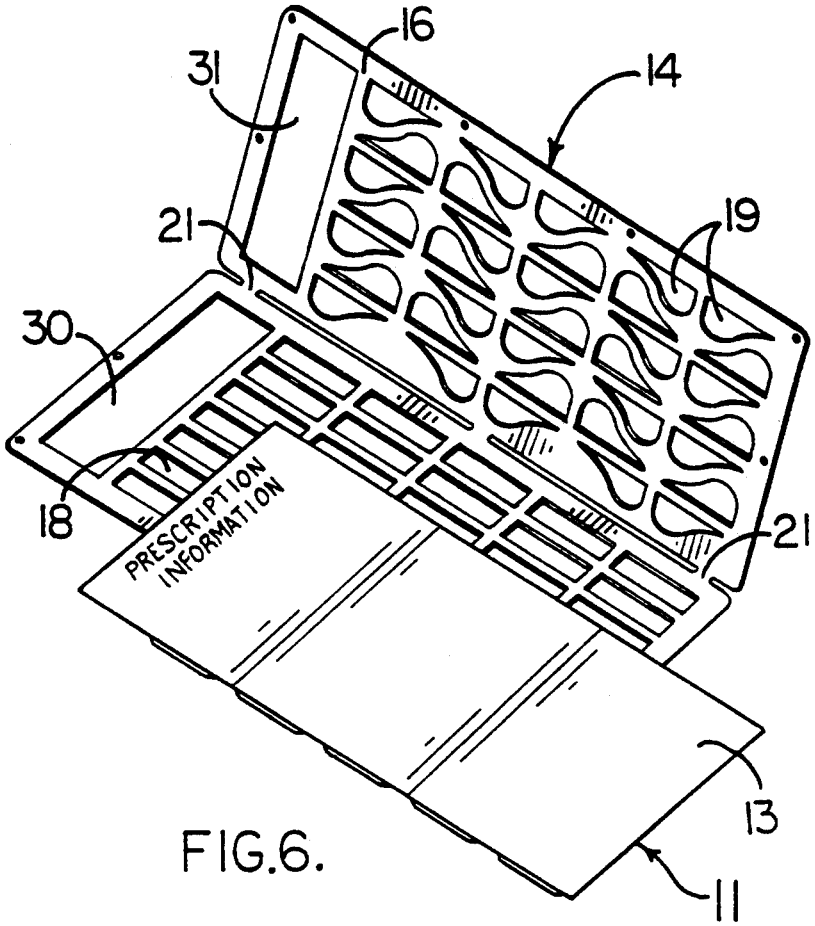
FIG. 6 is a perspective view similar to FIG. 5 with the lidding sheet applied to the blister sheet.
Figure 7:
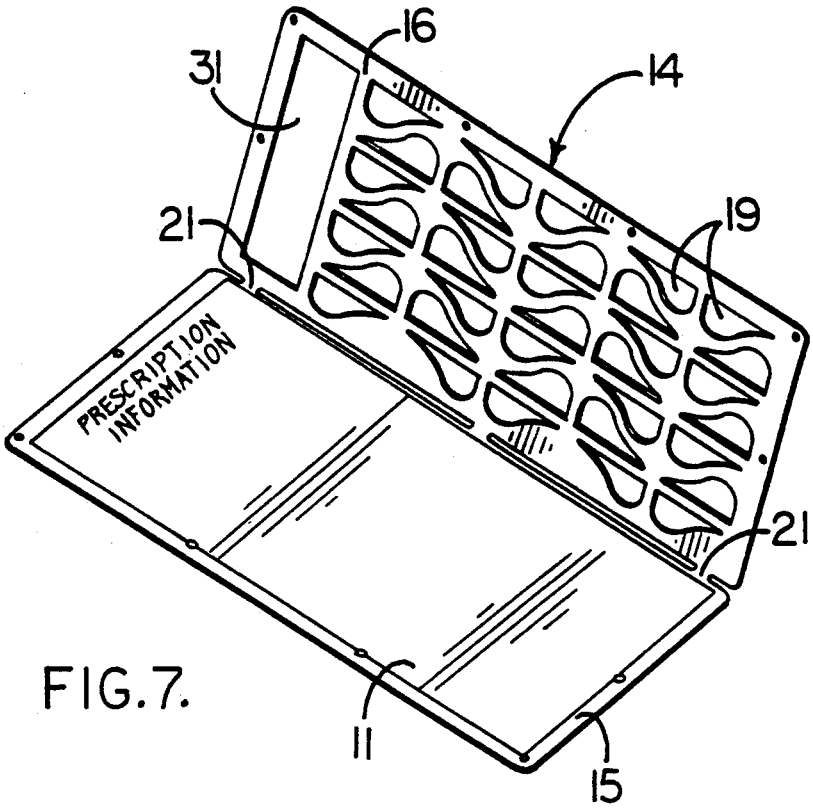
FIG. 7 is a perspective view similar to FIG. 6 showing the blister package positioned in the frame, ready for the frame to be closed.
Figure 8:
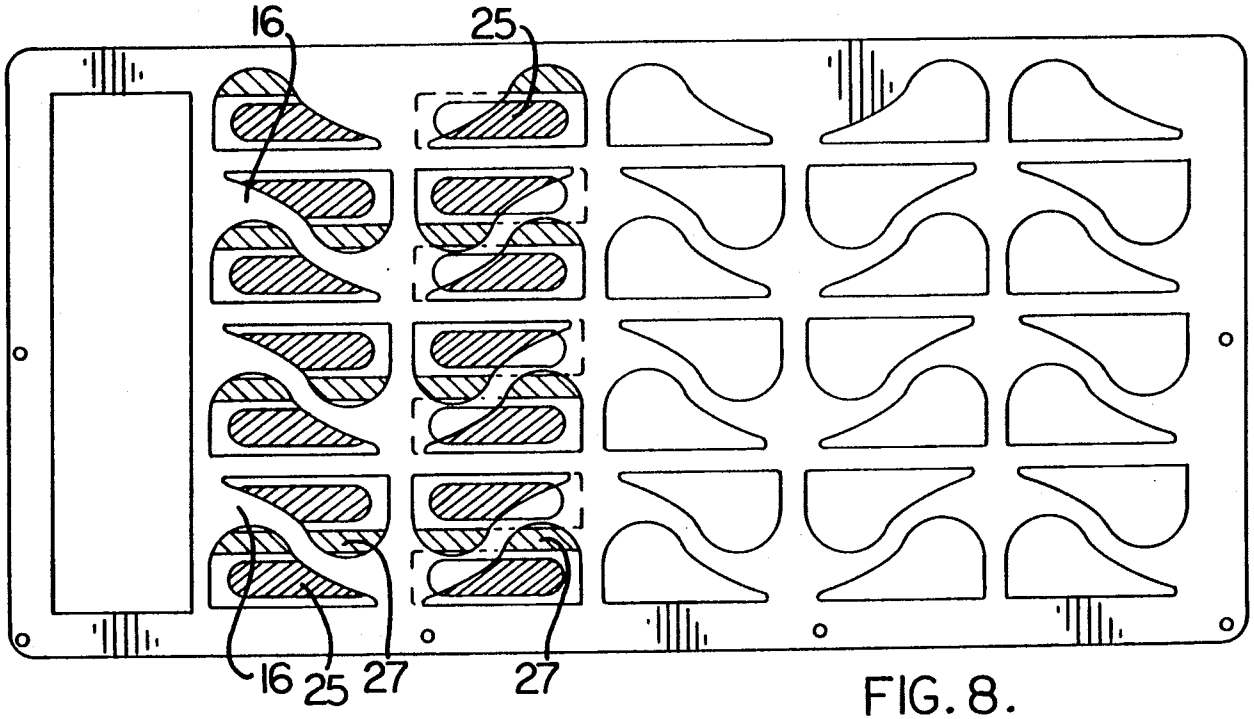
FIG. 8 is a bottom view of the package assembly when used for dispensing capsules.
Figure 11:
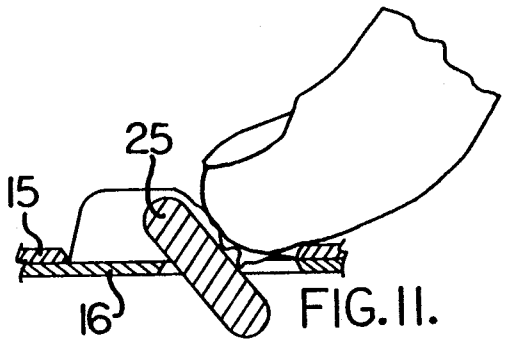
FIGS. 9–11 are side views of a single blister showing in an exemplary fashion how medication is removed from the blister.
Figure 10:
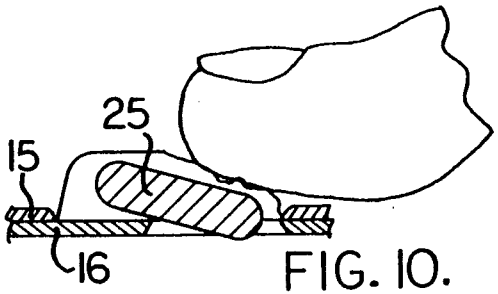
Figure 9:
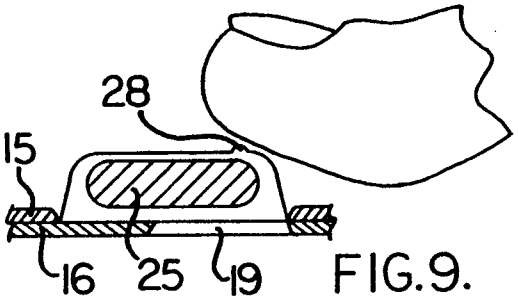

As seen in FIG. 1 and 3, the apertures 18 in panel 15 are rectangular in shape to receive the rectangularly shaped blisters 17 in blister sheet 12. The apertures 19 formed in panel 16 are correspondingly arranged with the apertures in the first or front panel so as to overlie the apertures when the panels are folded into the conventional face-to-face relation of the package. As seen best in FIG. 8, however, the apertures in the second panel have such a configuration as to partially obstruct the corresponding aperture in the first panel. The apertures 19, more particularly, are of an irregular configuration including a relatively large, radius portion 19*a* (FIG. 8) at one end and a relatively narrow, restricted portion 19*b* at the opposite end. As seen in FIG. 8, a capsule 25 is positioned in the generally rectangular blister. The relatively narrow restricted portion 19*b* of the second panel overlaps the generally rectangular blister and partially obstructs the release of the medication from the blister. However, the capsule can be readily removed through the large radius portion 19*a* of the aperture 19. Thus, as seen in FIGS. 9–11, a patient must press the correct end of the blister in order to burst the capsule through the lidding sheet. If a patient, or more appropriately a child, accidentally presses the incorrect end or even the center of the blister, the medication is blocked by the restricted portion 19*b* from breaking through the backing.

Figure 12:
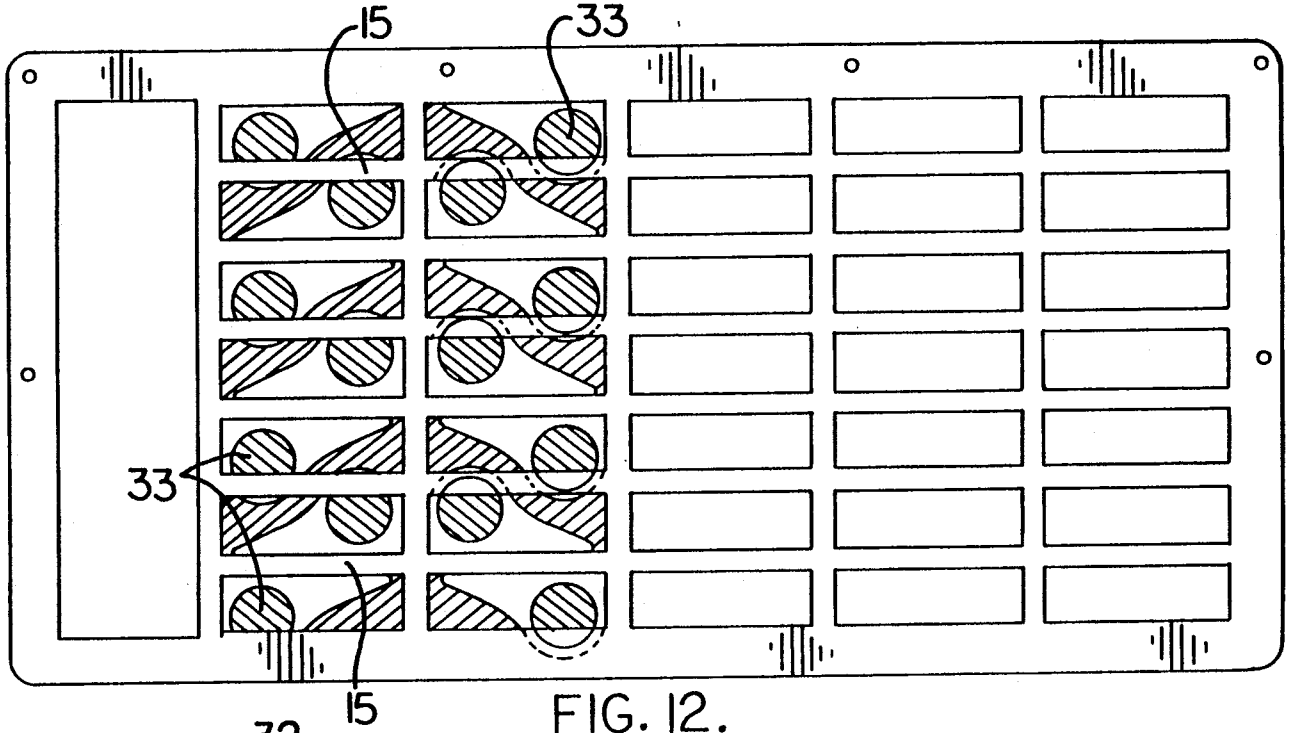
FIG. 12 is a bottom view of the package assembly when used for dispensing tablets.
Figure 13:
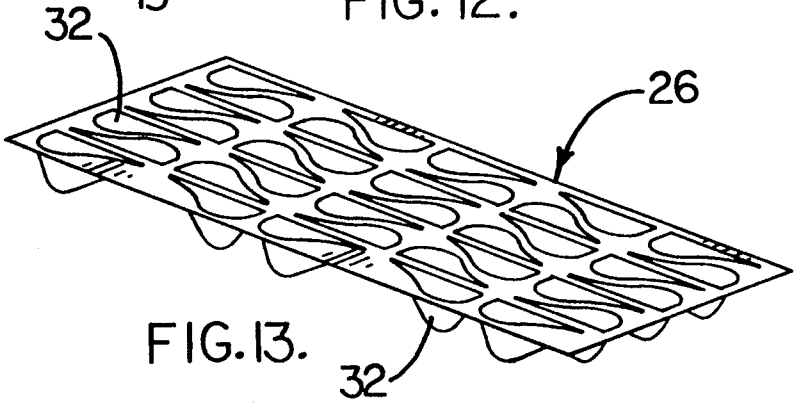
FIG. 13 is a bottom perspective view of the blister sheet used in connection with tablets.

The frame 14, with the rectangular and irregularly shaped apertures as just described, also can be used for the packaging of tablets that are typically circular in shape. In this case, as shown in FIG. 13, the blisters in the tablet blister sheet 26 would generally conform to the circular tablet and protrude through the apertures 19 in panel 16. As best seen in FIG. 12, the rectangular configuration of the apertures 18 of the first panel 15 partially obstructs the corresponding aperture 19 of the second panel 16. A tablet 33 is positioned in the irregularly shaped blister 32. The relatively large radius portion 19*a* of the second panel overlaps the generally rectangular aperture thereby partially obstructing the release of a tablet from the blister. However, the tablet can be readily removed through the unobstructed side of the irregularly shaped blister. As with capsules illustrated in FIG. 8, there is a specific side of the blister that must be pressed to burst the medication through the backing sheet. Pressure on the wrong side or in the middle of the blister is blocked.

While embodiments are shown in the attached drawings having a unique specific configuration that allows the frame to be used with conventional capsules or tablets, there are certainly many different configurations of frames that could be envisioned in which the second or back frame partially blocks the corresponding recess holding the medication to prevent or impede unwanted removal of medication from a given blister package.

The thermoplastic polymer that makes up the plastic sheet should desirably have sufficient barrier properties to prevent the diffusion of unwanted moisture and oxygen into the blister recesses of the package that may spoil or deactivate the packaged medications. This barrier property may be formed by including a barrier layer or coating in the plastic sheet before it is thermoformed or pressed into the blister sheet form. The method of forming the sheet and the various compositions of the sheet are well known in the industry. The lidding sheet is made of frangible material, typically relatively thin and flexible metal foil or plastic, that has barrier properties like those discussed above to insure the hermetic preservation of medications sealed in the package.

As best seen in FIGS. 1 and 9, each recess of the blister package may also include a molded bump or indentation or other tactile indicator 28 positioned on the end of the blister that should be pressed in order to burst the medication through the backing sheet. In the preferred embodiment, the bump or indentation alternates the sides of the blister as the partial obstruction from the backing panel also alternates sides. This bump allows a patient to easily identify where the blister needs to be pressed to get to the medication. On the other hand, the alternating location of the irregularly configured apertures 19 and therefore the bump or indentation enhances the child resistant nature of the package.

The invention also contemplates the formation of blisters having a non-uniform thickness. The portion of the blister comprising the side of the blister that must be pressed to burst the medication through the backing has a thicker width than the portion of the blister that is blocked by the second or back panel. The blister may be gradually thicker beginning from the thin side to the thicker and more reinforced side; or there may simply be two gradations of thickness of the blister. This variable thickness enhances the child resistant feature of the package. By reinforcing the side of the blister that is the side necessary to press the medication through the backing sheet, it is less likely that a child will be able to accidentally or inadvertently press such a medication out of the package. Additionally, the thin film on the opposite side of the blister may be more easily squeezed or pinched to force the medication out through the open end of the aperture.

The lidding sheet may be formed of a frangible material that can be printed on, or alternatively, a backing sheet can also be applied to the rear surface of the lidding sheet of the blister package. The backing sheet is preferably coated with an adhesive or glue material for adhering the backing sheet to the lidding sheet. The backing sheet is preferably made of paper, because it is easy to print information on the side of the backing sheet opposite the side having the adhesive and that relates to the packaged medications. The printed information, that can be written, typed or generated by a computer printer, sets forth required pharmaceutical labeling information, and the printed information is in registry with respective ones of the blister recesses and apertures. Thus, the specific contents of each blister recess may be set forth in matrix form that corresponds to the blister recesses of the package when the backing sheet is applied to the lidding sheet.

To further identify the specific correlation between the printed information on the backing sheet of the package with respect to the blister containing the medication on the other side of the package, certain codes may be used to match the information with the correct blister. For instance, the seven rows of blisters can each be assigned a letter A–G. Likewise, the five columns could be assigned and numbered 1–5. The printed information on the back of the backing sheet correlating to each blister would also include an alphanumeric designation identifying the row and column. In this way, a patient may read the information on the back of the package and make sure that he or she is bursting the correct pill through the backing. Other designations other than numbers and letters, and other combinations thereof, may certainly be used. Also, each blister and corresponding recess may be assigned separate indicia as an identifier.

In practice, a pharmacist will be provided with a kit to prepare and assemble the package assembly on an individual basis pursuant to an individual's prescription. The kit includes plastic blister sheets and a supply of lidding sheets. The kit may also include a supply of backing sheets to be adhered to the back of the lidding sheet to identify the contents of the blisters. The kit may further include a supply of plastic frames to give the finished package assembly support and rigidity.

While a particular embodiment of the invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and the scope of the invention.

That which is claimed is:

1. A package assembly for dispensing pharmaceutical medications, comprising a blister package, including a blister sheet having a plurality of blisters formed therein, said blisters projecting from one face of the sheet and forming recesses in the opposite face, medications positioned in such recesses, and a lidding sheet overlying said opposite face of said blister sheet for enclosing said medications in the blister recesses, and a frame receiving and supporting said blister package therein, said frame comprising first and second panels and a hinge joining said panels along adjacent edges thereof, the panels being folded into opposing face-to-face relation for sandwiching said blister package therebetween;

a plurality of apertures formed in said first panel, each aperture having a predetermined configuration; and a plurality of apertures formed in said second panel and being correspondingly arranged with the apertures in said first panel so as to overlie the apertures in said first panel when the panels are folded into opposing face-to-face relation, the apertures in said second panel being of such a configuration as to partially obstruct the corresponding aperture in said first panel while being of a configuration sufficient to allow passage of medication through the apertures in said second panel, the partial obstruction thereby forming a protective device to impede unwanted removal of medication from the blister package.

2. A package assembly according to claim 1, wherein the apertures of said first panel are so configured and arranged as to also partially obstruct the corresponding aperture in said second panel.

3. A package assembly according to claim 1, wherein the apertures in said first and second panels are arranged in a plurality of columns and a plurality of rows.

4. A package assembly according to claim 1 further comprising indicia on said first panel defining a unique identifying designation for each aperture in said first panel and indicia on said second panel defining the corresponding unique identifying designate for the corresponding apertures in said second panel.

5. A package assembly according to claim 1, wherein the apertures in said first panel are of a generally rectangular configuration, and the blisters of said blister sheet protrude through said rectangular apertures and are of an elongate configuration of a size adapted for receiving an elongate capsule-shaped medication.

6. A package assembly according to claim 5, wherein the apertures in said second panel are of an irregular configuration including a relatively large, radius portion at one end thereof and a relatively narrow, restricted portion at the opposite end thereof, the relatively large, radius portion overlying one end portion of the corresponding rectangular aperture, and the narrow, restricted portion overlying and partially obstructing the opposite end portion of the corresponding aperture so that an elongate capsule-shaped medication located in the blister can be removed only by pressing the blister at the nonobstructed end thereof.

7. A package assembly according to claim 1, wherein the apertures in said second panel are of an irregular configuration including a relatively large radius portion at one end thereof and a relatively narrow restricted portion at the opposite end thereof, and the blisters of said blister sheet protrude through said apertures are of a round configuration of a size adapted for receiving a tablet-shaped medication.

8. A package assembly according to claim 7, wherein the apertures in said first panel are of a generally rectangular configuration and overlie one side of the relatively large, radius portion of the corresponding irregular aperture to partially obstruct the same so that a round tablet-shaped medication located in the blister can be removed only by pressing the blister at the nonobstructed side thereof.

9. A package assembly according to claim 1 additionally including a tactile indicator associated with each blister of said blister sheet and located on the blister at a location away from the partial obstruction defined by the apertures in said second panel so that patient can identify by feel the proper location on the blister to press for gaining access to the medication.

10. A package assembly according to claim 1 wherein said blisters are comprised of a plastic material having a non-uniform thickness, said plastic material being thick on the side of a blister which is in opposing relation to nonobstructed portion of the corresponding aperture in the second panel overlying said blister, and thin on the side of the blister which is in opposing relation to the partial obstruction caused by the second panel.

11. A packaging device comprising first and second panels;

a hinge joining said panels along adjacent edges thereof so that the panels can be folded over into opposing face-to-face relation for sandwiching a blister package therebetween;

a plurality of apertures formed in said first panel of a generally rectangular configuration and of a size adapted to receive a capsule;

a plurality of apertures formed in said second panel and being correspondingly arranged with the apertures in said first panel so as to overlie the apertures in said first panel when the panels are folded into opposing face-to-face relation, and the apertures in said second panel being of an irregular configuration as to partially obstruct the corresponding aperture in said first panel, said irregular configuration including a radius portion at one end thereof for receiving a tablet.

12. A packaging device according to claim 11, wherein the apertures of said first panel are so configured and arranged as to also partially obstruct the corresponding aperture in said second panel.

13. A packaging device according to claim 12, wherein the apertures in said first and second panels are arranged in a plurality of columns and a plurality of rows.

14. A packaging device according to claim 13, wherein the apertures in said first and second panels are arranged in seven columns and five rows.

15. A package device according to claim 11, further comprising indicia on said first panel defining a unique identifying designation for each aperture in said first panel and indicia on said second panel defining the corresponding unique identifying designate for the corresponding apertures in said second panel.

16. A package assembly for dispensing pharmaceutical medications, comprising a blister package, including a blister sheet having a plurality of elongate capsule-shaped blisters formed therein and arranged in rows and columns, said blisters projecting from one face of the sheet and forming recesses in the opposite face adapted for receiving capsule-shaped medications therein, and a lidding sheet overlying said opposite face of said blister sheet for enclosing said medications in the blister recesses, and a frame receiving and supporting said blister package therein, said frame comprising first and second panels and a hinge joining said panels along adjacent edges thereof, the panels being folded into opposing face-to-face relation for sandwiching said blister package therebetween;

a plurality of apertures formed in said first panel and arranged in rows and columns, each aperture having a generally rectangular configuration and having one of the blisters of said blister sheet protruding therethrough; and a plurality of apertures formed in said second panel and being correspondingly arranged with the apertures in said first panel so as to overlie the apertures in said first panel when the panels are folded into opposing face-to-face relation, the apertures in said second panel being of an irregular configuration having a relatively narrow restricted portion at one end thereof positioned so as to overlie and partially obstruct one end of the corresponding rectangular aperture in said first panel, the partial obstruction thereby forming a protective device to impede unwanted removal of medication from the blister package.

17. A package assembly for dispensing pharmaceutical medications, comprising a blister package, including a blister sheet having plurality of round tablet-shaped blisters formed therein and arranged in rows and columns, said blisters projecting from one face of the sheet and forming recesses in the opposite face adapted for receiving tablet-shaped medications therein, and a lidding sheet overlying said opposite face of said blister sheet for enclosing said medications in the blister recesses, and a frame receiving and supporting said blister package therein, said frame comprising first and second panels and a hinge joining said panels along adjacent edges thereof, the panels being folded into opposing face-to-face relation for sandwiching said blister package therebetween;

a plurality of apertures formed in said first panel and arranged in rows and columns, each aperture having an irregular configuration including a relatively large, radius portion at one end thereof and a relatively narrow, restricted portion at the opposite end thereof, and having one of the blisters of said blister sheet protruding therethrough; and a plurality of apertures formed in said second panel and being correspondingly arranged with the apertures in said first panel so as to overlie the apertures in said first panel when the panels are folded into opposing face-to-face relation, the apertures in said second panel being of a generally rectangular configuration and positioned so as to overlie one side of the relatively large, radius portion of the corresponding irregular aperture to partially obstruct the same so that a round tablet-shaped medication located in the blister can be removed only by pressing the blister at the nonobstructed side thereof.

* * * * *